United States Patent [19]

Wolbrink et al.

[11] Patent Number: 4,594,940

[45] Date of Patent: Jun. 17, 1986

[54] FAN FOR VENTILATION

[75] Inventors: David W. Wolbrink, Hartford; Dieter W. Otte, Rubicon, both of Wis.

[73] Assignee: Broan Mfg. Co., Inc., Hartford, Wis.

[21] Appl. No.: 764,953

[22] Filed: Aug. 9, 1985

Related U.S. Application Data

[63] Continuation of Ser. No. 586,050, Mar. 5, 1984, abandoned.

[51] Int. Cl.[4] ..... F24F 7/06

[52] U.S. Cl. ..... 98/42.1; 98/42.08; 98/116

[58] Field of Search ..... 52/27, 39; 98/33.1, 98/39.1, 42.02, 42.07, 42.08, 42.09, 42.1, 116; 248/342, 343; 206/517, 518

[56] References Cited

U.S. PATENT DOCUMENTS

| | | | |
|---|---|---|---|
| 1,532,635 | 4/1925 | Osbun . | |
| 2,278,581 | 4/1942 | Dexter | 98/43 R |
| 2,668,491 | 2/1954 | Gerlitz . | |
| 3,064,548 | 11/1962 | Field . | |
| 4,385,550 | 5/1983 | Steiner et al. | 98/43 R |
| 4,510,851 | 4/1985 | Sarnosky et al. | 98/42.08 |

OTHER PUBLICATIONS

"Direct Drive Whole House Fans", Spartan Electric Company, Fayetteville, N.C.

"Whole House Fan and Shutter System", *Emerson Owners Manual*, Model No. WH20W5, Emerson Environmental Products, Bennettsville, S.C., Dec. 1982.

*Primary Examiner*—Harold Joyce

*Attorney, Agent, or Firm*—Andrus, Sceales, Starke & Sawall

[57] ABSTRACT

A ventilation fan structure has a fan blade-motor portion and a shroud portion independently affixable to the ceiling to reduce noise levels, improve aerodynamic efficiency, and facilitate installation. A mounting member is affixable to ceiling joists, one of which spans an opening in the ceiling for the fan structure. The drive motor and associated fan blades are mounted on the mounting member. The shroud surrounds the ceiling opening and embraces the fan blades. The mounting member extends through the shroud in its attachment to the joists.

9 Claims, 4 Drawing Figures

FIG. 1
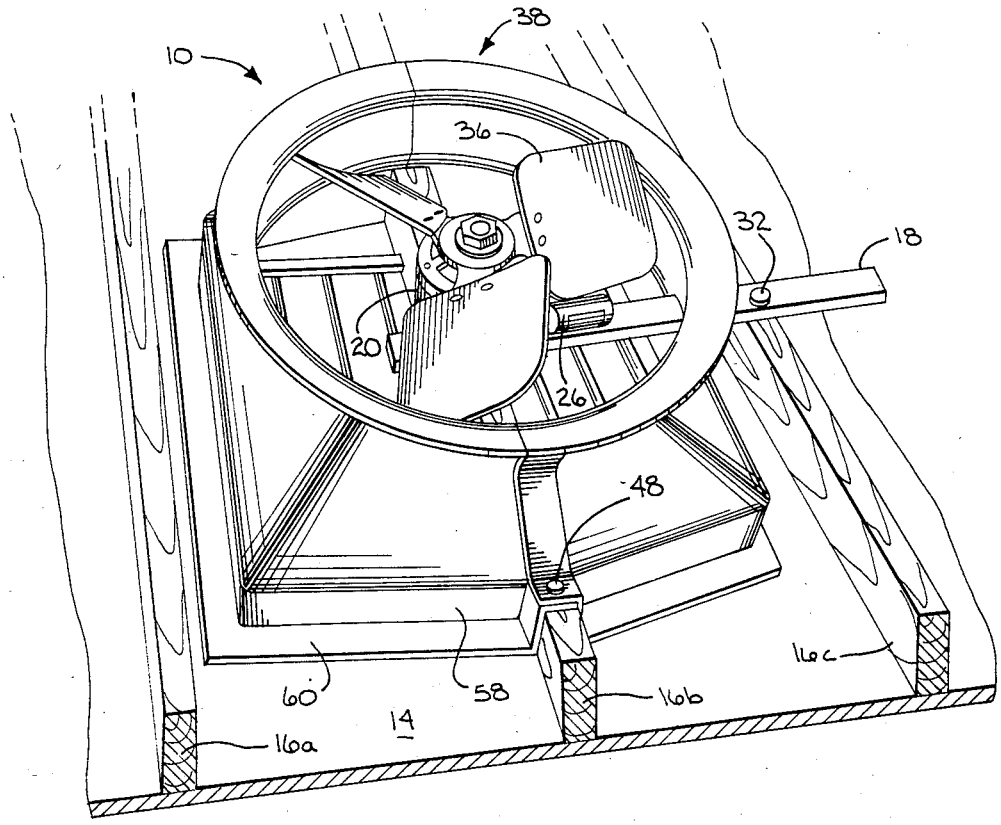
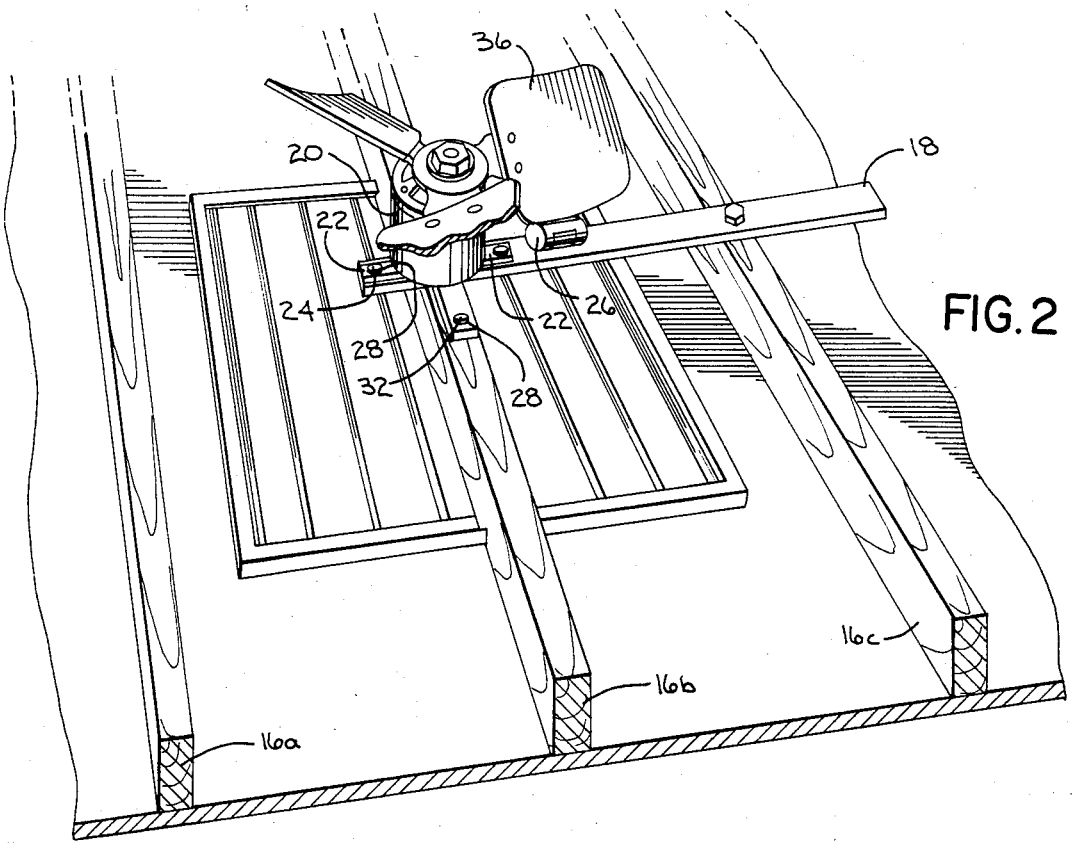
FIG. 2

FIG. 3
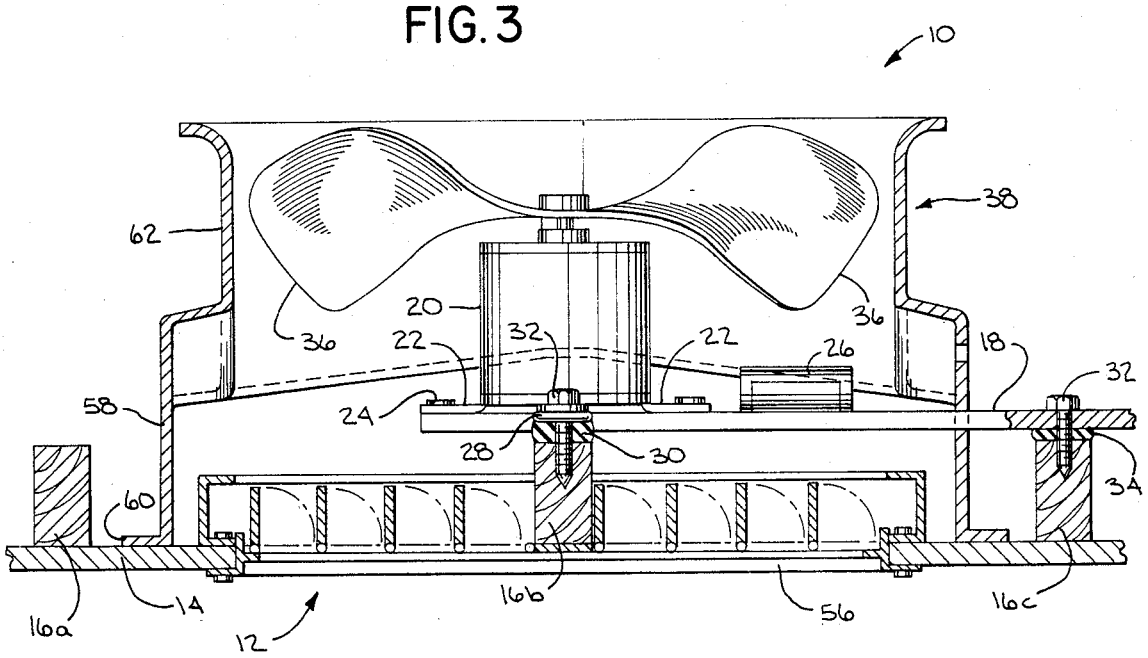
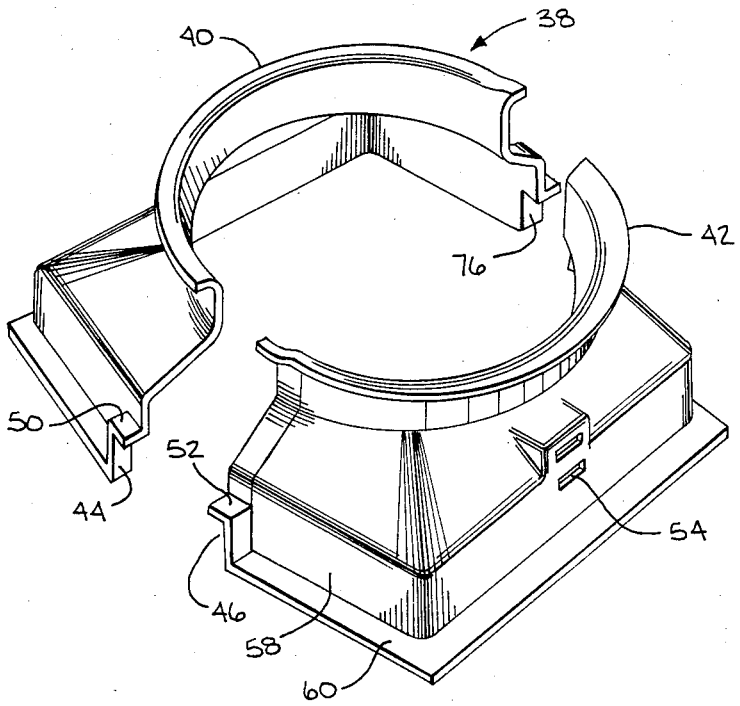
FIG. 4

FAN FOR VENTILATION

This is a continuation of application Ser. No. 586,050 filed Mar. 5, 1984 now abandoned.

Ventilation fans of the so-called "whole house" type are mounted in the ceiling of a house immediately below the attic. The fan draws up air from the basement or lower portions of the house, passes it through an opening in the ceiling, and discharges it out a vent in the gable or roof. Ventilation and cooling are thus provided to the house.

Typical fans currently in use include a box that surrounds the hole in the ceiling and is fastened to the ceiling joists. A sheet metal shroud extends across the box. Arched metal frames on the shroud or box support the fan blades adjacent the shroud. The fan may be directly coupled to the driving motor or, the motor may be mounted in an off-set position on the frame, shroud, or box and connected to the fan by a belt.

A number of problems exist in such fans. One such problem is undesirable noise levels. These usually arise from the somewhat cantilevered mounting of the fan blades and motor on the arched frames that transmits and enhances vibrations of the fan and motor, the tendency of the sheet metal shroud to resonate such vibration, and the difficulty in effectively applying vibration absorbing material to the fan. The aerodynamic efficiency of the fan is lessened because of the configurational limitations on the shroud, particularly its axial depth, imposed by the frames and because of structural compromises needed to obtain physical strength, vibration resistance, and other necessary or desired properties.

Installation of the fan is difficult and usually requires severing one or more ceiling joists in order to install the box. In many cases, the ceiling joist is also a stringer of a roof truss. Such a member is tensioned when the roof truss is loaded and severance may cause displacement of the rafters.

Recent designs have facilitated installation by placing the fan between the joists or by leaving the joists in place and mounting the fan on the joists. Prefabricated elements are used to form the box. See for example U.S. Pat. No. 4,385,550 to Steiner et al.

It is the object of the present invention to provide an improved ventilation fan that, among other features, exhibits low operational noise levels, has high aerodynamic efficiency, and is easy to install.

These advantages are obtained in the fan structure of the present invention by mounting the fan blade-motor portion of the fan and the shroud portion of the fan independently of each other on the ceiling of the house. Such independent mounting reduces noise, particulary with respect to that generated in the shroud, since vibration transmission is blocked by the independent mounting. The independent mounting facilitates the placement of sound and vibration absorbing elements in the fan. It permits the shroud to be formed specifically for improved aerodynamic efficiency of the fan. Independent mounting of fan blade-motor portion and the shroud portion simplifies the installation of the ventilation fan and avoids the need to sever joists or stringers in the ceiling.

The fan structure of the present invention includes a mounting member or members affixable to the ceiling in its opening as by fastening to a joist extending across the opening and to a joist adjacent the opening. Vibration and sound absorbing pads may be interposed between the mounting members and the joists. The drive motor for the fan blades is attached to the mounting members above the joist extending across the opening. Additional vibration absorbing means may be interposed between the motor and the mounting members.

A, preferably multi-part, shroud is affixed to the ceiling or joists to surround the opening and embrace the fan blades. The shroud has a first portion mateable with the periphery of the ceiling opening and a second portion providing a tubular shroud adjacent the fan blades formed to enhance the aerodynamic efficiency of the fan. The mounting member for the drive motor extends through the shroud to the joist adjacent the opening.

The invention is further described with the aid of the drawing in which:

FIG. 1 is a perspective view of the improved ventilation fan structure of the present invention;

FIG. 2 is a perspective view of the fan structure FIG. 1 with the shroud removed and showing the remaining portions in a mounted position;

FIG. 3 is a cross-sectional view of the fan structure shown in FIG. 1; and FIG. 4 is a perspective view of the shroud portion of the fan structure shown in FIG. 1.

In the drawing, the improved ventilation fan structure of the present invention is indicated by the numeral 10. Fan 10 may be employed to exhaust air through opening 12 previously cut in building ceiling 14 for this purpose. Ceiling 14 is supported by joists or stringers 16*a*, 16*b*, and 16*c*. Opening 12 lies between joists 16*a* and 16*c*. While in the past, it has been necessary to cut away the portions of the stringer 16*b* extending across opening 12, the stringer is left intact with the ventilation fan structure of the present invention. Possible weakening of roof truss is thus avoided.

A mounting member means, comprised of a bar 18, has motor 20 mounted adjacent one end, as by brackets 22 and fasteners 24. See FIG. 2. Elements of motor 20, such as the starting capacitor 26, may be secured to bar 18, if desired. Additional brackets 28 extend from either side of the end of bar 18 containing motor 20 for attachment to joist 16*b*. It is anticipated that motor 20 and bar 18 will be factory assembled and supplied to the installer as a unit for installation on the joists.

Brackets 28 are secured to joist 16*b* by means of resilient washers or grommets 30 and fasteners 32 in a vibration insulating and absorbing manner. Motor 20 is positioned generally over joist 16*b*. The other end of bar 18 is fastened to joist 16*c* by resilient washer or grommet 34 and fastener 32. Vibration absorbing means may be interposed between bar 18 and brackets 22, if desired. Fan blades 36 are secured to the output shaft of motor 20.

Shroud 38 surrounds motor 20, and fan blades 36. As shown most clearly in FIG. 4, shroud 38 may be a two-part structure comprised of a generally symmetrical pair of halves 40 and 42 that overlap adjacent a central parting line for joinder by appropriate fasteners, glue, or the like. Notches 44 and 46 in each of the halves are provided along the parting line so that shroud 38 can fit over joist 16*b* for positioning as shown in FIG. 10. Fastener 48 extending through overlapping tabs 50 and 52 on halves 40 and 42 secures shroud 38 to joist 16*b*. As shown in FIG. 4, shroud 38 contains a slot 54 through which bar 18 may extend, also as shown in FIG. 3. A plurality of such slots can be provided to accommodate bar 18 when fastened to joists of different height. The notches 44 and 46 and the surrounding portions of shroud 38 can also be formed so as to accommodate joists of different heights, as by means of knock-outs or the like.

The two-piece shroud 38 facilitates the installation of the fan blade structure in that the pieces can easily fit through the opening 12 in ceiling 14 part joist 16*b*. The use of louvers 56 is also facilitated. Since only one joist 16 passes through opening 12, interference with louvers 56 is minimized. This avoids the need to use a drop housing in order to insure opening of a sufficient number of louver panels to obtain the required ventilation.

Shroud 38 has a lower, generally rectangular portion 58, the flange 60 of which serves to seal opening 12. The upper portion of the shroud 38 is a generally tubular configured portion 62 that embraces fan blades 36. Inasmuch as shroud 38 is affixed to the building separately and independently of the mounting means for motor 20 and is thus freed from the constraints and compromises found in conventional designs, shroud 38 may assume the shape necessary to enhance the aerodynamic efficiency of fan blades 36. Shroud 38 may have a venturi like configuration and closely embrace the tips of fan blades 36 to avoid tip recirculating air currents. The transition portion between rectangular portion 58 and tubular portion 62 may provide the desired inlet curve and conditions for fan blades 36. Shroud 38 may be formed of light weight, non-load bearing, material, such as ABS plastic, glass reinforced plastic, expanded polystyrene, or sheet metal. It may also be formed of a vibration absorbing material, such as paper-mache.

We claim:

1. A ventilation fan structure positionable across an opening in a bulding member having a pair of structural elements, one of which extends across the opening, the other of which does not, said fan structure comprising:

a mounting member spanning the structure mountable thereon in the opening of the building member, said mounting member having one end fastenable to the structural element extending across the opening and the other end fastenable to the other structural element;

rotary drive means fastened to said mounting member so as to be positioned above said mounting member and generally in alignment with the structural element extending across the building member opening;

rotatable fan blade means coupled to said rotary drive means for moving air through the opening, said fan blade means being positioned above said mounting member and generally in alignment with the structural element extending across the building member opening; and a shroud affixable to the building member independently of said mounting member means and at least partially surrounding said mounting member, said shroud having a first portion mateable with the periphery of the building member opening and formed to accommodate the structural element extending across the opening and a second portion formed to embrace said fan blade means and having a venturi-like configuration, said mounting member extending through said shroud for mounting to the other structural element of the pair.

2. The fan structure according to claim 1 wherein said first and second portions of said shroud are integrally formed and wherein said shroud has at least parting line lying normal to the opening in the building member.

3. The fan structure according to claim 2 wherein said shroud is formed as a multi-part element having a pair of parting lines lying normal to the opening in the building member.

4. The fan structure according to claim 1 wherein said second portion of said shroud means provides, at least adjacent the plane of rotation of said fan blade means, a generally tubular element formed to enhance the aerodynamic efficiency to the fan blade means.

5. The fan structure according to claim 4 wherein said shroud means has a curved inlet portion intermediate said first and second portions for further enhancing the aerodynamic efficiency of the fan blade

6. The fan structure according to claim 1 including vibration absorbing means interposable intermediate said mounting member and the building element.

7. The fan structure according to claim 1 including vibration absorbing means interposed intermediate said mounting member and said drive means.

8. The fan structure according to claim 6 said mounting member means and said drive means.

9. The fan structure according to claim 1 including louver means operatively associated with the opening in said building member.

* * * * *

UNITED STATES PATENT AND TRADEMARK OFFICE

CERTIFICATE OF CORRECTION

PATENT NO. : 4,594,940

DATED : June 17, 1986

INVENTOR(S) : DAVID W. WOLBRINK, DIETER W. OTTE

It is certified that error appears in the above-identified patent and that said Letters Patent is hereby corrected as shown below:

| | |
|---|---|
| Column 2, Line 62, | After "Fig." cancel "10" and substitute therefor---1---; |
| Column 3, Line 36, | Cancel "bulding" and substitute therefor---building---; |
| Column 4, Line 22, | After "least" insert---one---; |
| Column 4, Line 43, | After "claim 6" insert--- including vibration absorbing means interposed intermediate---. |

Signed and Sealed this

Eighth Day of September, 1987

*Attest:*

DONALD J. QUIGG

*Attesting Officer*

*Commissioner of Patents and Trademarks*